US005804946A

United States Patent [19]

Gaubatz et al.

[11] Patent Number: 5,804,946

[45] Date of Patent: Sep. 8, 1998

[54] DUAL TOWER FUEL TANK FOR A MOTOR GENERATOR SET

[75] Inventors: Tommy L. Gaubatz, Liverpool; Paul J. Spaulding, Syracuse, both of N.Y.

[73] Assignee: Carrier Corporation, Syracuse, N.Y.

[21] Appl. No.: 752,239

[22] Filed: Nov. 19, 1996

[51] Int. Cl.[6] ..... F02B 63/00

[52] U.S. Cl. ..... 322/1; 123/2; 62/239

[58] Field of Search ..... 322/1, 100; 123/2; 62/239

[56] References Cited

U.S. PATENT DOCUMENTS

| | | | |
|---|---|---|---|
| 4,548,164 | 10/1985 | Ylonen et al. | 123/2 |
| 4,629,031 | 12/1986 | Kato et al. | 181/204 |
| 4,677,940 | 7/1987 | Bracht et al. | 123/2 |
| 4,732,360 | 3/1988 | Bodenheimer | 248/645 |
| 4,748,824 | 6/1988 | Wakabayashi et al. | 62/239 |
| 4,811,569 | 3/1989 | Welch et al. | 62/239 |
| 4,834,401 | 5/1989 | Harrington et al. | 280/833 |
| 5,181,541 | 1/1993 | Bodenheimer | 137/899 |
| 5,187,945 | 2/1993 | Dixon | 62/234 |
| 5,433,175 | 7/1995 | Hughes et al. | 123/2 |
| 5,590,806 | 1/1997 | Green et al. | 220/562 |
| 5,609,037 | 3/1997 | Fischler | 62/239 |
| 5,678,512 | 10/1997 | Colton | 123/2 |

*Primary Examiner*—Steven L. Stephan
*Assistant Examiner*—Nicholas Ponomarenko

[57] ABSTRACT

A fuel tank for a self contained generator set of the type adapted to be mounted on a transport container, which has a refrigeration unit mounted on one end thereof. The generator set is adapted to provide electrical power for the refrigeration unit. The outer perimeter of the end of the transport container and the refrigeration unit mounted thereon cooperate to define a predetermined envelope in which the generator set must be mounted. The predetermined envelope is defined by the top of the container, the lateral sides of the container and at the lower end by the location of the condenser fan discharge and operating controls of the refrigeration unit. The fuel tank of the generator set is substantially U-shaped having a lower section substantially co-extensive with the lower end of the predetermined envelope and first and second vertically extending sections which extend to the top of the envelope and which are substantially co-extensive with the two lateral sides of the envelope. In a preferred embodiment, the lower section of the fuel tank and the two vertically extending sections cooperate to define a space in which is mounted the motor generator assembly of the generator set.

3 Claims, 6 Drawing Sheets

DUAL TOWER FUEL TANK FOR A MOTOR GENERATOR SET

BACKGROUND OF THE INVENTION

The present invention relates to self contained engine driven electrical generators. More particularly, the invention relates to a fuel tank for a self contained engine driven electrical generator of the type used in connection with a refrigerated transport container wherein the engine, generator fuel tank and other principal components are assembled in a single unit.

An increasingly popular way of transporting goods makes use of removable cargo carrying containers, commonly referred to as "intermodal" containers, which are adapted for transport over both land and water. Such containers are designed for transport by truck or rail to a freight terminal or ship loading dock, where they may be transferred to a ship for overseas delivery.

Many of such containers are provided with refrigeration units which allow them to transport perishable goods therein. The refrigeration units attached to such containers include an electric motor for driving a refrigerant compressor forming a part of the unit. As a result, they require a source of electrical power for operation. When located at a freight terminal, a refrigerated container is provided with electrical power through a connection to a conventional source of electrical power. When located on a ship, a refrigerated container receives electrical power from the ship's electrical system. When being transported by road, rail or when no other power source is available, a self contained temporary power source which includes a motor generator set, may be mounted directly to the refrigerated container.

Since the generator set is a self-contained source of auxiliary power, it is necessary that an integral part thereof be a fuel tank for the motor, which is typically a diesel engine. Many generator sets are required to have the capability to provide uninterrupted service for an extended length of time. For example, for transcontinental rail shipping, it is desirable to have a generator set which is capable of operating for more than 130 hours without requiring refueling. Such extended use capabilities also will increase the reliability of the system and decrease operating costs. Accordingly, it is desirable to provide a high capacity integral fuel tank for such a generator set.

It should be appreciated that space is extremely limited in the design of such a generator set. Such space limitations are a result of the environment in which they are used wherein there are limitations on components extending beyond a prescribed envelope universally defined by the width of the containers on which they are used. Also, because such generator sets are quite often mounted on containers being towed by tractor trailers, size limitations are dictated by the necessity of providing adequate clearance between the generator and the tractor unit. Further space limitations are dictated by the requirement that the generator set not extend vertically above the top of the container on which it is mounted nor should it extend downward such that it would interfere with the condenser discharge and the operating controls of the refrigeration unit.

One approach to achieving a high capacity fuel tank has been to provide a substantially U-shaped fuel tank having a lower section, which underlies and supports the motor generator and other components of the generator set and which comprises upstanding sections on one or both sides of the generator set. Units are known which have two short towers or one full height tower and one short tower.

The height of such towers in prior art units has been limited by problems regarding engine cooling, exhaust system locations and other space restraints dictated by the generator set and its peripherals.

A U.S. patent application entitled "Removable "Powertray" For A Self Contained Motor Generator Set", assigned to the assignee of the present invention, was filed on Dec. 26, 1995, as U.S. Ser. No. 08/578,263. This application describes a motor generator set wherein the power generation section including the engine, electrical generator, radiator, and all other major components are included as integral parts of the power generation section.

Another U.S. patent application entitled "Fuel Tank Having Pass Through Conduits", also assigned to the assignee of the present invention, was filed on Dec. 26, 1995, as U.S. Ser. No. 08/578,400. The '400 patent application discloses a fuel tank design for a self contained motor generator set wherein passageways are formed in sections of the fuel tank, which allow passage of the motor generator assemblies exhaust pipe and power cables therethrough.

SUMMARY OF THE INVENTION

The present invention relates to a self contained generator set of the type adapted to be mounted on a transport container, which has a refrigeration unit mounted on one end thereof. The generator set is adapted to provide electrical power for the refrigeration unit. The outer perimeter of the end of the transport container and the refrigeration unit mounted thereon cooperate to define a predetermined envelope in which the generator set must be mounted. The predetermined envelope is defined at its upper end by the top of the container, laterally by the sides of the container and at its lower end by the location of the condenser fan discharge and operating controls of the refrigeration unit. The generator set includes a fuel tank, which has a lower section. The lower section of the fuel tank has a bottom which is substantially co-extensive with the lower end of the predetermined envelope and further defines a substantially horizontal structural support surface. The fuel tank also includes a first substantially vertical section extending upwardly from the lower section within the envelope which is co-extensive with one of the lateral sides of the envelope. The upper end of the first section is substantially co-extensive with the upper end of the envelope. The fuel tank includes a second substantially vertical section extending upwardly from the lower section within the envelope which is co-extensive with the other of the lateral sides. The second section has an upper end substantially co-extensive with the upper end of the envelope and is horizontally spaced from the first section. In a preferred embodiment, the motor generator assembly of the self contained generator set is mounted on the horizontal structural support surface.

BRIEF DESCRIPTION OF THE DRAWINGS

This invention may be better understood and its objects and advantages will become apparent to those skilled in the art by reference to the accompanying drawings, in which.

DESCRIPTION OF THE PREFERRED EMBODIMENT

Figure 1:
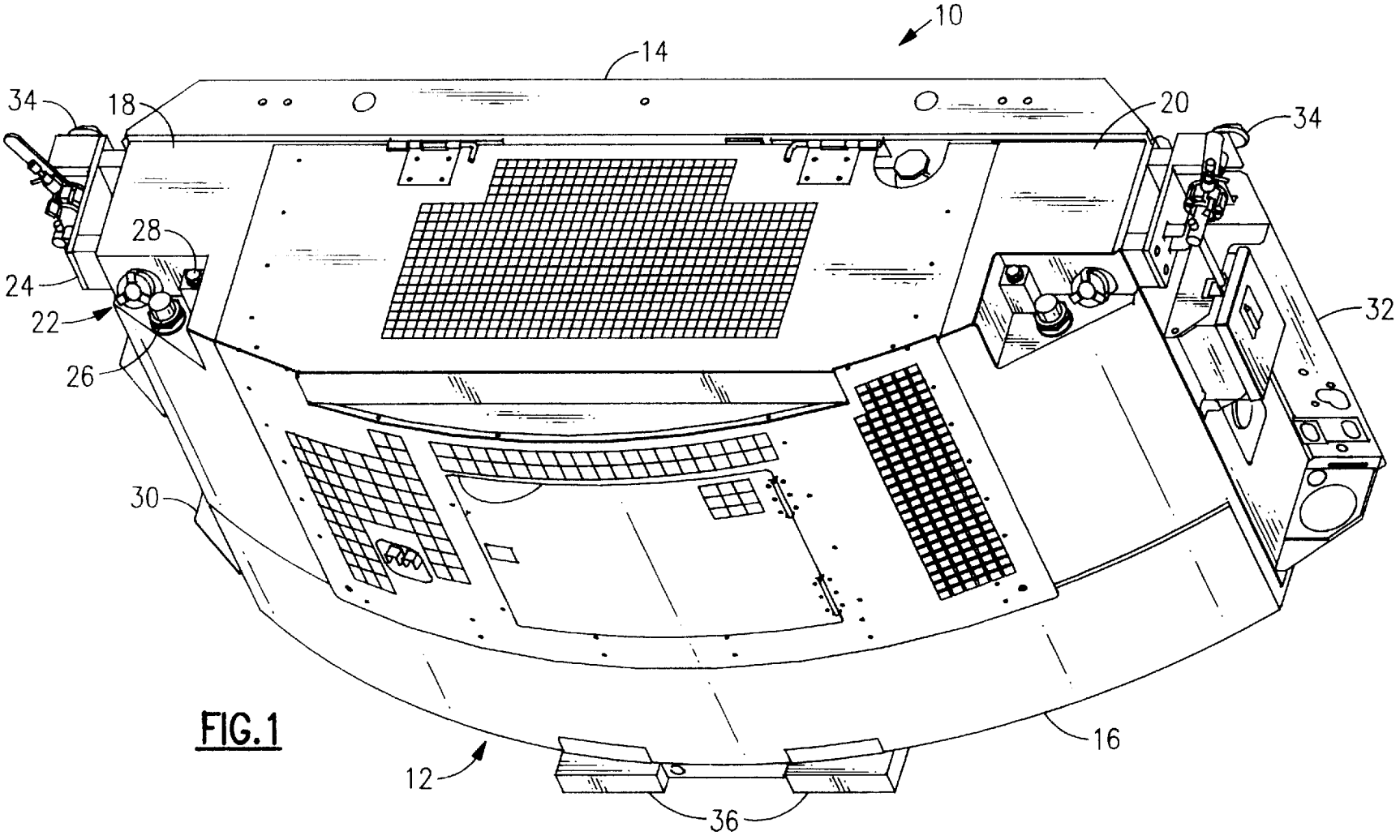
FIG. 1 is a perspective view of a self contained generator set having a fuel tank according to the present invention with the outer cover installed.

FIG. 1 is a perspective view of a diesel driven generator set 10, which is adapted for mounting on the end of a refrigerated container in order to provide electric power to a refrigeration unit which is also mounted on the container. In operation, the generator set 10 provides a constant electrical power supply for operation of the all electric refrigeration unit. A container refrigeration unit adapted for mounting on a refrigerated container, and with which the generator set of the present invention may be used, is manufactured and sold by the Carrier Transicold Division of Carrier Corporation and marketed as Model Series NT.

Figure 2:
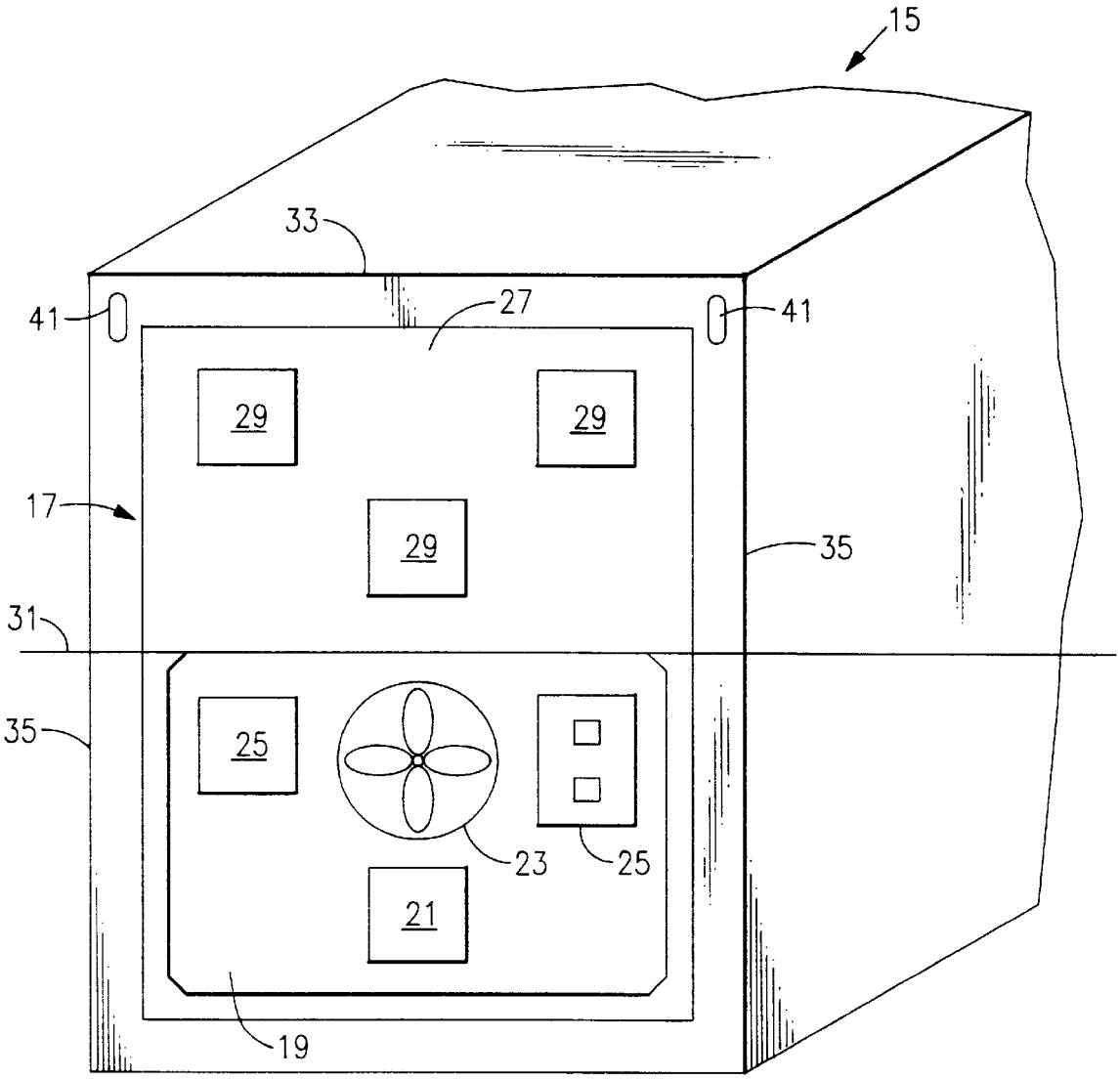
FIG. 2 is a simplified perspective view of a refrigerated contained adapted for installation of a generator set according to the present invention.

FIG. 2 schematically illustrates the end of such a refrigerated container 15 having a refrigeration unit 17 such as the aforementioned Carrier Transicold unit mounted thereon. The refrigeration unit is shown schematically and includes a lower "open" section 19, which includes the compressor 21, the condenser fan 23, and controls, generally, 25. An upper section 27 encloses the evaporator fans and other components which are accessible by removal of covers 29. The lower and upper sections 19 and 27 are shown divided by an imaginary line 31, which defines the lower end of an envelope in which a generator set 10 mounted to the container must fit. The upper end of the envelope is defined by the top 33 of the container and the sides of the envelope are defined by the vertical sides 35 of the container.

Referring now to FIGS. 1, 3, 4, 5 and 6, the structural framework of the generator set comprises a U-shaped fuel tank generally designated by reference numeral 12 and a number of structural elements, including an angle iron 14, which extends across substantially the entire back of the generator set.

The fuel tank 12, fabricated from structural steel plate, comprises a lower section 16, which extends across substantially the entire bottom of the generator set 10. Extending from the left and right hand sides of the lower tank 16 are left and right hand tower portions of the fuel tank, 18 and 20, respectively. Each of the towers 18 and 20 is fluidly interconnected with the lower tank section 16. Each of the towers 18 and 20 is provided, at its upper end thereof, with a fuel fill shelf 22, which is provided with an appropriate fuel fill 24, fuel gage 26 and fuel vent 28.

The previously described structural angle 14 is welded to the top of the back side of the fuel towers 18 and 20. Other structural elements include left and right hand vertical extending structural members 30 and 32, respectively, located at the left and right hand ends of the generator set. Preferably, these structural elements 30 and 32 are welded to the left and right hand facing surfaces of the fuel tank towers 18 and 20, respectively. Mounted to the upper end of the structural elements 30 and 32 are suitable clamps 34 well known in the art, which are adapted to structurally attach the generator set 10 to a refrigeration container of the type shown in FIG. 2.

Underlying the lower portion 16 of the fuel tank 12 are a pair of structural forklift pockets 36, which form an integral part of the generator set structure and facilitate engagement by a forklift for lifting the unit and positioning it for attachment to a refrigerated container.

Figure 6:
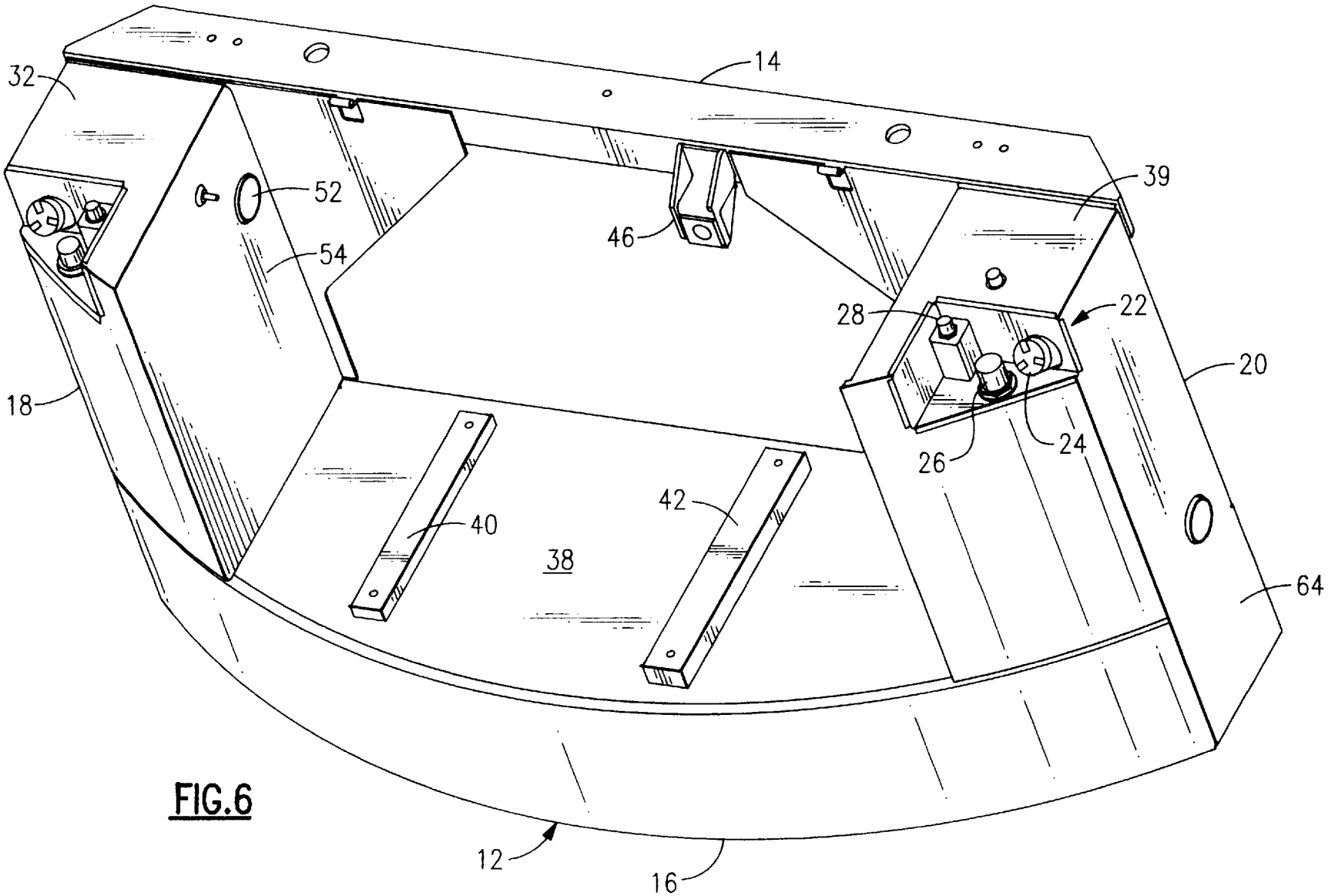
FIG. 6 is a perspective view of the generator set of FIG. 1 with many of the components removed therefrom to show details of the fuel tank according to the present invention.

As best shown in FIG. 6, the upwardly facing planar surface 38 of the lower portion 16 of the fuel tank 12 has a pair of mounting bars 40 and 42 attached thereto. Attached to the angle iron 14 is an angular mounting bracket 46. The mounting bars and the bracket are the attachment points for the motor and generator of the generator set.

Figure 3:
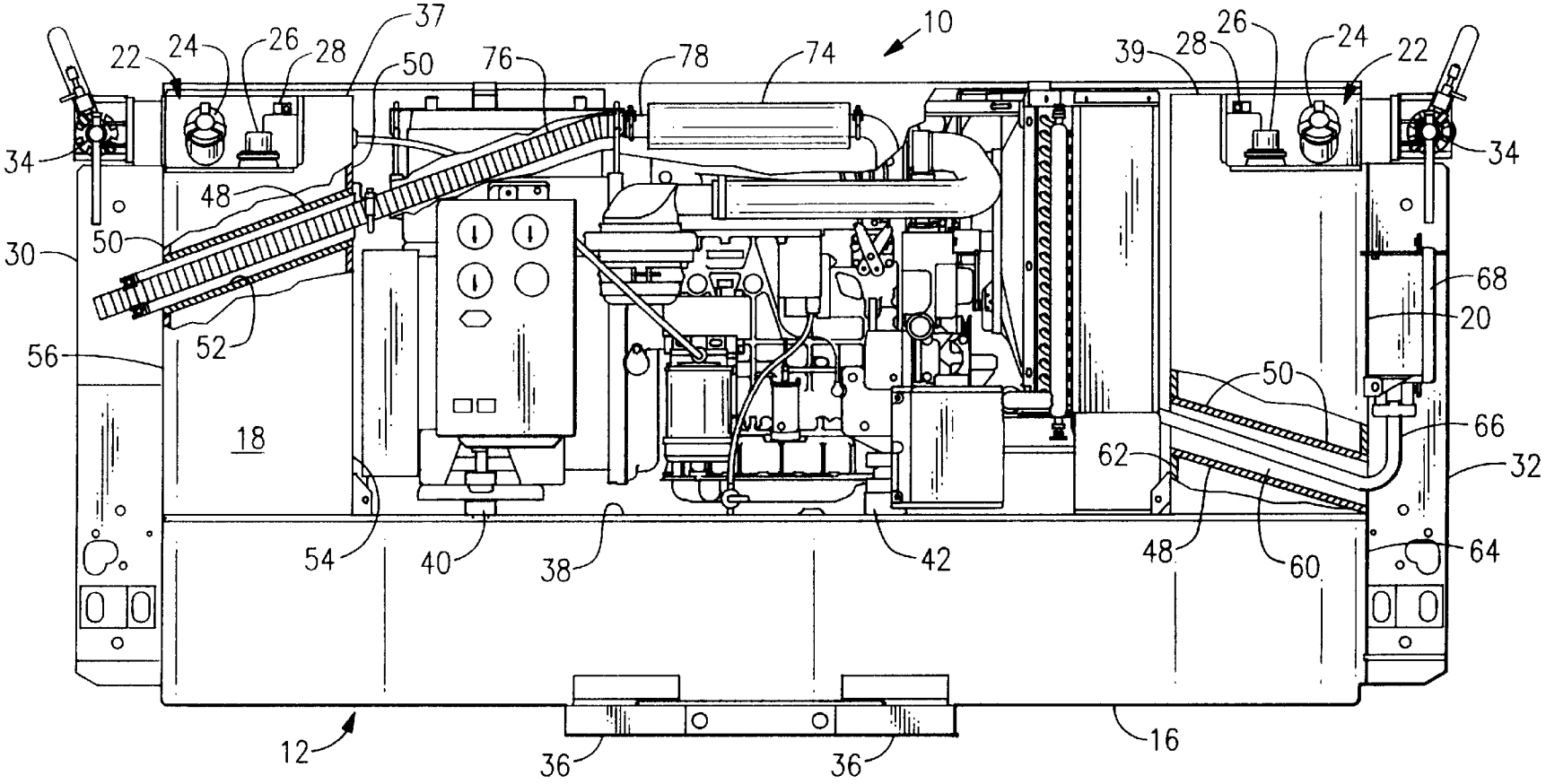
FIG. 3 is a front elevation view of the generator set of FIG. 1 with the cover removed and having sections of the fuel tank partially broken away.
Figure 4:
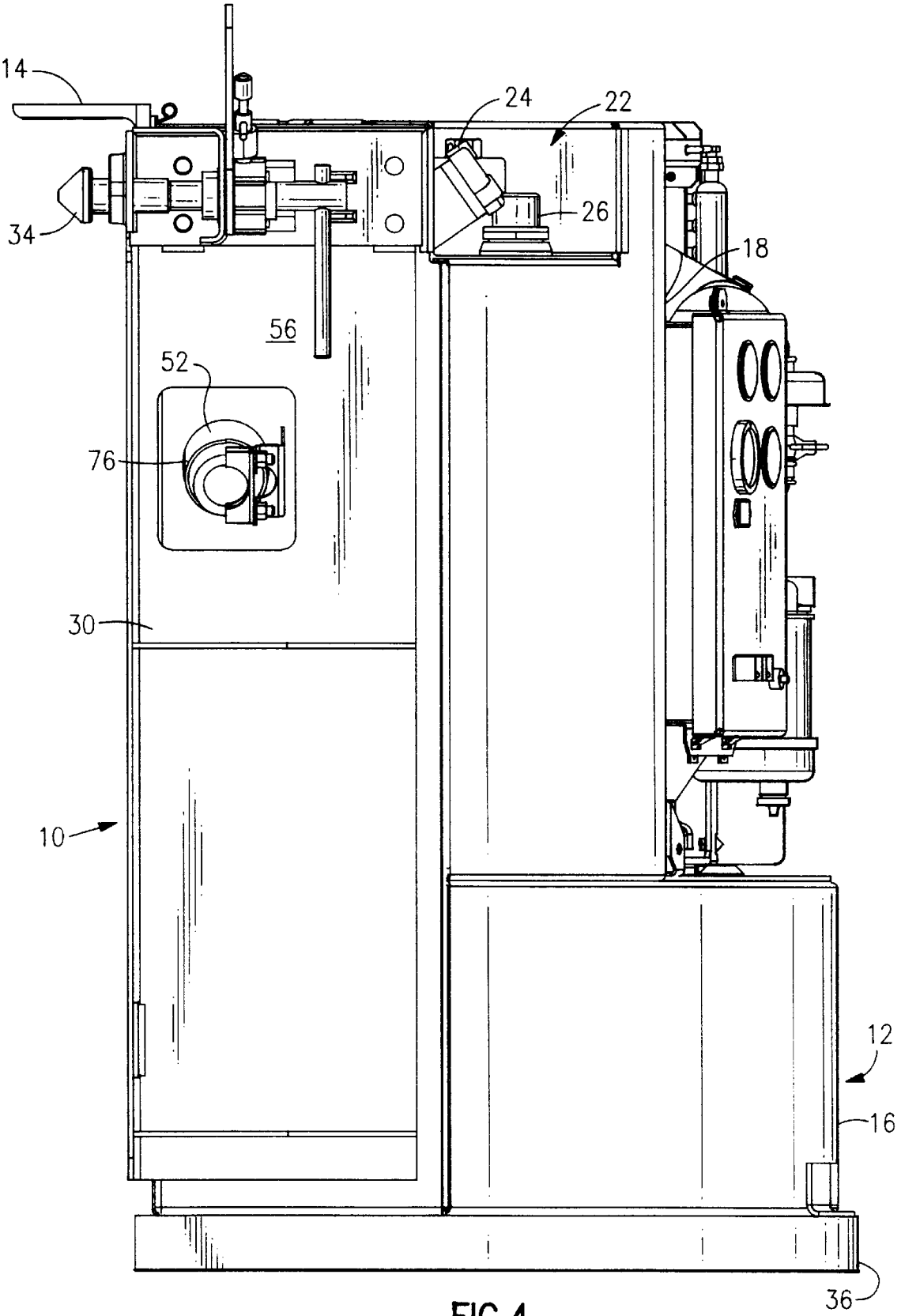
FIG. 4 is a left side view of the unit illustrated in FIG. 3.
Figure 5:
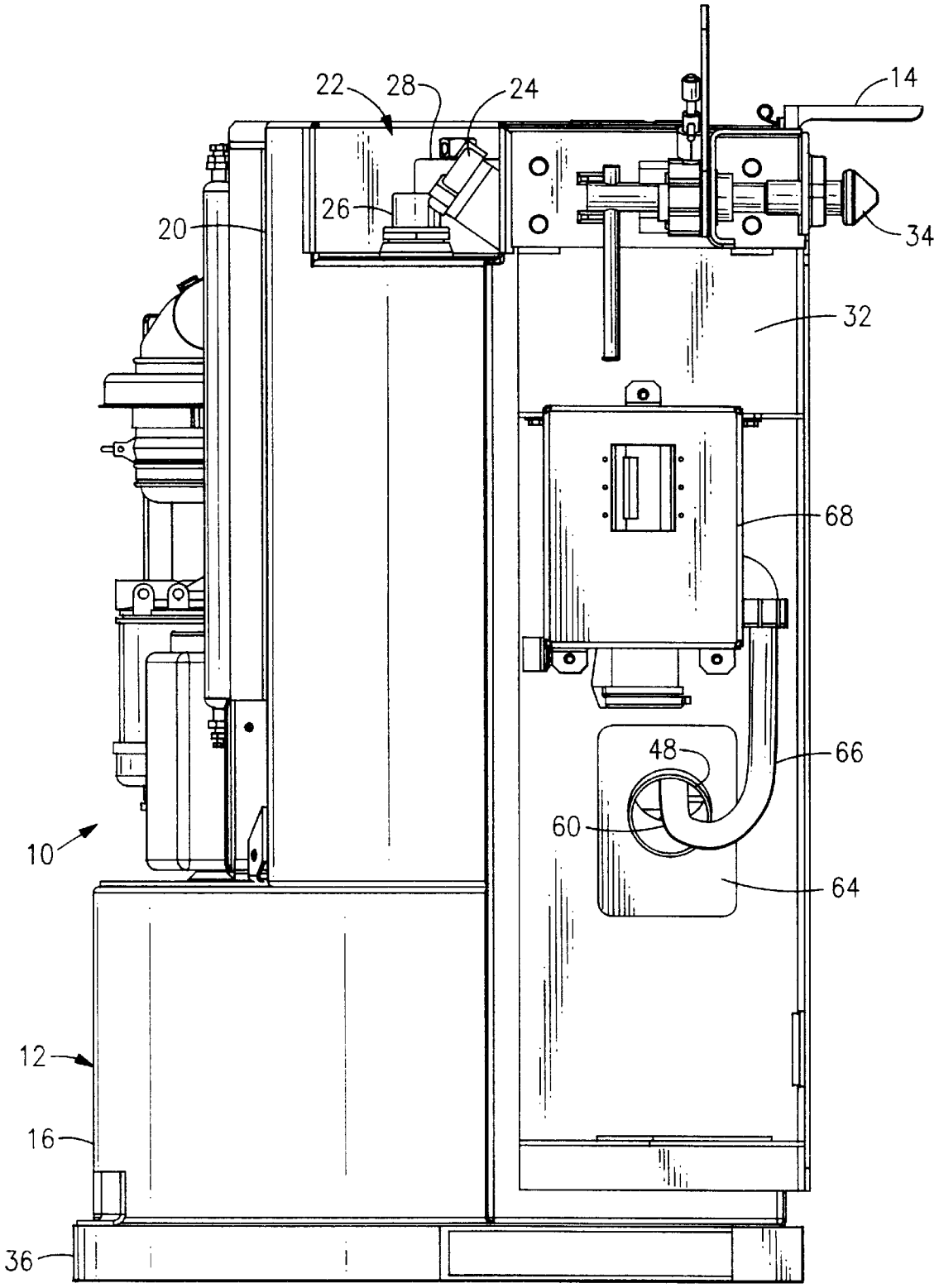
FIG. 5 is a right side of the unit illustrated in FIG. 3.

As best shown in FIGS. 3, 4 and 6, the left hand fuel tank tower 18 is provided with a circular passage 52 extending from the interior wall 54 thereof to the exterior wall 56. The passage is formed from a steel pipe section 48 integrally welded to openings 50 cut into the walls 54 and 56. As will be described in more detail, the exhaust pipe 58 from the engine of the generator set passes through the passage 52. The passage is inclined downward to facilitate drainage of rainwater or the life from the pipe 48.

In a like manner, the right hand tower 20 of the fuel tank is provided with a passage 60 extending from the interior wall 62 to the exterior wall 64 thereof. This passage 60 is adapted to receive the power cable 66, which interconnects the generator set 10 with a receptacle box 68 mounted on the right hand vertically extending structural member 32.

It should be appreciated that both of the passages 52 and 60 provide a convenient, easily fabricated passageway from the interior of the "confines" of the generator set 10 with a minimum of additional parts and while allowing the maximum capacity of the fuel tank. To emphasize the simplicity, each passage requires a simple length of purchased pipe or tubing, cut to length, and a single hole being cut in each panel of the fuel tank which is penetrated. The welding of the pipes to the fuel tank panels are relatively simple circumferential fillet welds.

Looking now at FIGS. 2, 3 and 4, again, the generator set includes principally a diesel engine 70 and a generator 72, which is coupled directly to the engine flywheel. The generator provides a constant 460 vac three phase, 60 hertz electrical supply which is conducted from the generator 72 via power cable 66 which passes directly through passage 60 in the right hand fuel tank tower 20 where it is interconnected as shown in FIG. 4 to a receptacle box 68.

The muffler 74 of the diesel engine 70 is connected to the exhaust manifold of the engine and has an exhaust pipe 76 connected directly to the outlet 78 of the muffler. The exhaust pipe 76 passes directly from the muffler outlet through the passage 52 in the left hand fuel tank tower 187 and thence exhausts to the exterior of the generator set. It should be noted that the passage 52 and the exhaust pipe passing therethrough are sized such that a circumfertial air space surrounds the exhaust pipe to facilitate cooling of the exhaust pipe and to prevent any undesired overheating of the fuel tank.

With reference now to all of the drawing Figures, it will be noted that the outer confines of the fuel tank 12 are such that the tank is substantially co-extensive with the previously described "envelope", which the self contained generator set 10 may occupy when installed on a refrigerated container. Specifically, it will be noted that the upper ends 37 and 39 of towers 18 and 20, respectively, extend to the top of the container when the generator set is mounted on the container with the clamps 34 engaging mating openings 41 provided in the upper end post of the container 15. Likewise, the bottom of the lower section 16 of the fuel tank is adapted to be substantially co-extensive with the line 31 defining the lower end of the envelope as shown in FIG. 2. With reference to FIG. 2, the extreme left hand wall 56 of the left hand tower 18, it will be noted is substantially co-extensive with the left hand vertical side 35 of the container being spaced therefrom a distance sufficient to allow access to the mounting clamp 34. Likewise, the right hand facing wall 64 of the right hand tower 20 is substantially co-extensive with the right hand vertical side 35 of the container again being spaced a sufficient distance to allow access to the clamp 34.

What is claimed is:

1. A self contained generator set of the type adapted to be mounted on a transport container, which has a refrigeration unit mounted on one end thereof, for providing electrical power for the refrigeration unit, the outer perimeter of the end of the transport container, and the refrigeration unit mounted thereon cooperating to define a predetermined envelope in which the generator set may be mounted, said predetermined envelope being defined at its upper end by the top of the container, laterally by the sides of the container, and at its lower end by the location of the condenser discharge and operating controls of the refrigeration unit, said generator set comprising:

a fuel tank having, a lower section, said lower section having a bottom which is substantially co-extensive with the lower end of said envelope, said lower section further including a substantially horizontal structural support surface;

a first substantially vertical section extending upwardly from said lower section within said envelope and co-extensive with one of the lateral sides thereof, said first section having an upper end substantially co-extensive with the upper end of said envelope; and a second substantially vertical section extending upwardly from said lower section within said envelope and co-extensive with the other of the lateral sides thereof, said second section having an upper end substantially co-extensive with the upper end of said envelope, said second section being horizontally spaced from said first section.

2. The apparatus of claim 1 wherein said substantially horizontal support surface of said lower section, and said spaced first and second vertical sections cooperate to define a space therebetween, and wherein said generator set further includes an electric generator and motor assembly mounted within said space.

3. The apparatus of claim 1 wherein said generator set further includes structural support members adapted to be positioned adjacent each of the lateral edges of said predetermined envelope, and, manually operable container attachment devices carried by each structural support member; and wherein each of said first and second vertical sections of said fuel tank is spaced from its respective said lateral side of said envelope a distance to allow access to said container attachment devices.

* * * * *